US005469023A

United States Patent [19]

Kirshner

[11] Patent Number: 5,469,023

[45] Date of Patent: Nov. 21, 1995

[54] CAPACITIVE STUB FOR ENHANCING EFFICIENCY AND BANDWIDTH IN A KLYSTRON

[75] Inventor: Mark F. Kirshner, Redwood City, Calif.

[73] Assignee: Litton Systems, Inc., Beverly Hills, Calif.

[21] Appl. No.: 185,484

[22] Filed: Jan. 21, 1994

[51] Int. Cl.[6] ..... H01J 23/40

[52] U.S. Cl. ..... 315/5.39; 315/5.51; 315/5.54; 315/39

[58] Field of Search ..... 315/5.39, 5.46, 315/5.48, 5.51, 5.53, 5.54, 39

[56] References Cited

U.S. PATENT DOCUMENTS

| | | | |
|---|---|---|---|
| 2,815,467 | 12/1957 | Gardner | 315/5.53 X |
| 2,970,242 | 1/1961 | Jepsen | 315/5.39 |
| 3,016,501 | 1/1962 | Gardner et al. | 315/5.21 |
| 3,028,519 | 4/1962 | Jepsen et al. | 315/5.48 X |
| 3,045,146 | 7/1962 | Haegele et al. | 315/5.21 |
| 3,305,799 | 2/1967 | Levin | 315/5.39 X |
| 3,453,483 | 7/1969 | Leidigh | 315/5.39 |
| 3,484,861 | 12/1969 | Dehn | 315/5.16 |
| 3,529,204 | 9/1970 | Van Iperen et al. | 315/5.39 X |
| 3,720,889 | 3/1973 | Gale | 315/5.53 X |
| 4,284,922 | 8/1981 | Perring et al. | 315/5.39 |
| 4,931,695 | 6/1990 | Symons | 315/5.39 |

FOREIGN PATENT DOCUMENTS

| | | |
|---|---|---|
| 1004976 | 9/1965 | United Kingdom . |
| 1199341 | 7/1970 | United Kingdom . |
| 2098390A | 11/1982 | United Kingdom . |

*Primary Examiner*—Benny T. Lee
*Attorney, Agent, or Firm*—Graham & James

[57] ABSTRACT

A capacitive stub for adjusting an impedance level of an output gap of a klystron is provided. The klystron includes an iris coupling RF power from the klystron to an output waveguide. The capacitive stub extends from an inner surface of the output waveguide into a position generally adjacent at least a portion of the iris. The stub is capable of adjustment from external to the output waveguide to vary the position of the stub relative to the iris, and in so doing, change the capacitance of the iris. By changing the iris capacitance, the impedance of the output gap can be altered.

7 Claims, 3 Drawing Sheets

CAPACITIVE STUB FOR ENHANCING EFFICIENCY AND BANDWIDTH IN A KLYSTRON

BACKGROUND OF THE INVENTION

1. Field of the Invention

The present invention relates to efficiency enhancements for microwave amplification devices, and more particularly, to a novel capacitive stub for adjusting the impedance level across an output gap of a klystron that provides enhanced efficiency and bandwidth for the klystron.

2. Description of Related Art

Linear beam tubes are used in sophisticated communication and radar systems which require amplification of an RF or microwave electromagnetic signal. A conventional klystron is an example of a linear beam microwave amplifier. A klystron comprises a number of cavities divided into essentially three sections: an input section, a buncher section, and an output section. An electron beam is sent through the klystron, and is velocity modulated by an RF electromagnetic input signal that is provided to the input section. In the buncher section, those electrons that have had their velocity increased gradually overtake the slower electrons, resulting in electron bunching. The traveling electron bunches represent an RF current in the electron beam. The RF current induces electromagnetic energy into the output section of the klystron as the bunched beam passes through the output cavity, and the electromagnetic energy is extracted from the klystron at the output section. An output waveguide channels the electromagnetic energy to an output device, such as an antenna.

The development of high powered klystron amplifiers which operate at a peak power level higher in relation to pulse length and frequency than that of conventional klystrons has resulted in beam voltage levels generally higher than that previously achieved. To avoid RF breakdown in the output section due to the high beam voltage, multi-cavity output circuits were developed. The multi-cavity output circuits, known as extended interaction output circuits (EIOC), have the advantage that a higher level of impedance across a greater bandwidth can be achieved, enabling better impedance matching with the electron beam and leading to greater efficiency of operation. An EIOC used to produce high power microwave energy with large instantaneous bandwidth is referred to as an extended interaction klystron (EIK), and can be used to produce power over bandwidths in excess of ten percent. An example of a high performance EIOC is disclosed in U.S. Pat. No. 4,931,695, to Symons.

The function of the output circuit of a klystron or EIK is to convert the kinetic energy of the electron beam into RF power. This is accomplished by generating an impedance level across the output gap (or gaps in the case of an EIK) roughly equivalent to the product of the DC beam impedance and the gap coupling coefficient. The value of the output gap impedance is the product of cavity R/Q (equivalent to the capacitive reactance of the gap, R being the shunt resistance and Q being the quality factor of the cavity) and the $Q_{total}$. Since the R/Q is dependent upon gap geometry, it is constrained by a number of factors (most notably the coupling coefficient) and thus is not easily adjusted after assembly. The value of $Q_{total}$ is the parallel addition of the internal cavity Q (determined by internal resistive losses), beam loaded Q (a complex function of both beam current and velocity modulation), and external Q (dependent upon the degree of coupling to the output waveguide). Varying any of these values will alter the amount of impedance developed across the output gap (or gaps).

Since the resistive losses in the cavity and the modulation on the beam are factors which are not easily modified, one is generally constrained to controlling the cavity Q by concentrating on changing the external Q by adjusting the coupling between the cavity and the output waveguide. This is generally accomplished by use of an inductive waveguide coupling iris which is positioned between the cavity and the output waveguide. The principal drawback to this method is that once the dimensions of the coupling iris are set, it is difficult to further modify the external Q once a completed device is assembled and evacuated. Since the exact level of impedance necessary for maximum efficiency is dependent on many factors, the external Q selected is often less than optimum.

Accordingly, it would be desirable to provide an apparatus for use with a klystron or EIK that enables adjustment of the impedance level across the output gap after assembly and evacuation is complete. Such an apparatus would provide enhanced efficiency and bandwidth for the klystron or EIK. It would be further desirable to provide an apparatus having the above characteristics, while being relatively simple to design and cost effective to fabricate.

SUMMARY OF THE INVENTION

In accordance with the teachings of this invention, an apparatus for adjusting an impedance level of an output gap of a klystron is provided. The klystron includes an iris coupling RF power from the klystron to an output waveguide. The adjusting apparatus comprises a capacitive stub extending from an inner surface of the broad wall of the output waveguide into a position generally adjacent at least a portion of the iris. The stub is capable of adjustment from external to the output waveguide to vary the position of the stub relative to the iris, and in so doing, change the capacitance of the iris. By changing the iris capacitance, the impedance of the output gap can be altered.

More particularly, the stub has an electrically conductive surface, and a generally rounded end. A threaded member is coupled to the stub and extends externally of the output waveguide. A diaphragm couples the stub to the output waveguide, with the stub being centrally disposed in the diaphragm. The diaphragm maintains a vacuum within the output waveguide, and permits a range of motion for the stub relative to the iris. Rotation of the threaded member causes an associated change in position of the stub.

A more complete understanding of the capacitive stub for enhancing efficiency and bandwidth in a klystron will be afforded to those skilled in the art, as well as a realization of additional advantages and objects thereof, by consideration of the following detailed description of the preferred embodiment. Reference will be made to the appended sheets of drawings which will be first described briefly.

DETAILED DESCRIPTION OF THE PREFERRED EMBODIMENT

The present invention provides an adjustable capacitive stub for a klystron (or EIK) that enables adjustment of the impedance level across the output gap of the klystron, in order to provide enhanced efficiency and bandwidth. Moreover, the capacitive stub has generally simple construction and occupies a relatively small amount of volume with respect to the klystron, enabling the stub to be advantageously utilized within a design envelope of existing microwave amplification systems.

Figure 1:
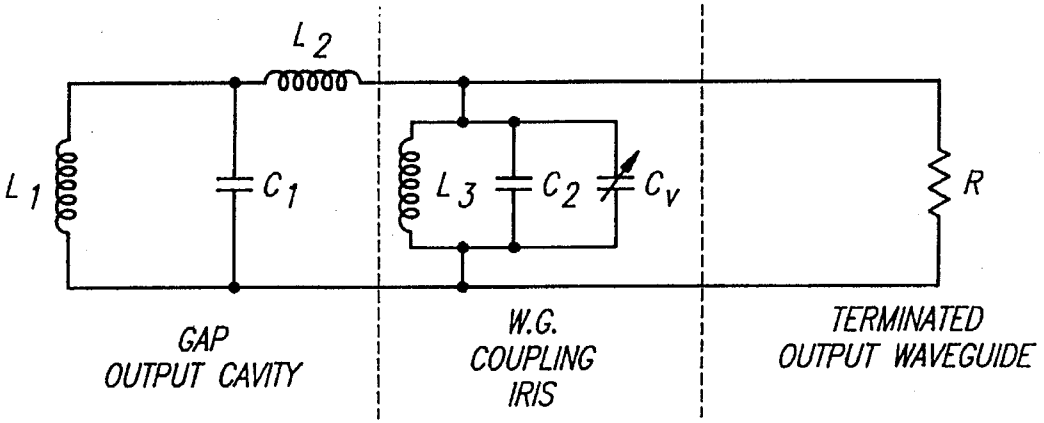
FIG. 1 illustrates an electrical schematic of a single cavity output klystron with a variable capacitive stub of the present invention.

Referring first to FIG. 1, an equivalent electrical circuit for a klystron is illustrated. The klystron includes an output cavity, a waveguide coupling iris that couples the output cavity to an output waveguide, and the output waveguide. The output cavity, with its corresponding electron beam gap, is represented by a cavity capacitance $C_1$, a first portion of the cavity inductance $L_1$ in parallel with the cavity capacitance, and a second portion of the cavity inductance $L_2$ coupled to the coupling iris. The coupling iris is represented by a parallel L-C circuit including an iris inductance $L_3$ and shunt capacitance $C_2$ across the iris. The L-C circuit further contains a variable capacitance $C_V$ which will be further described below. The resistance R represents the load of the output waveguide properly terminated in its characteristic impedance.

Figure 2:
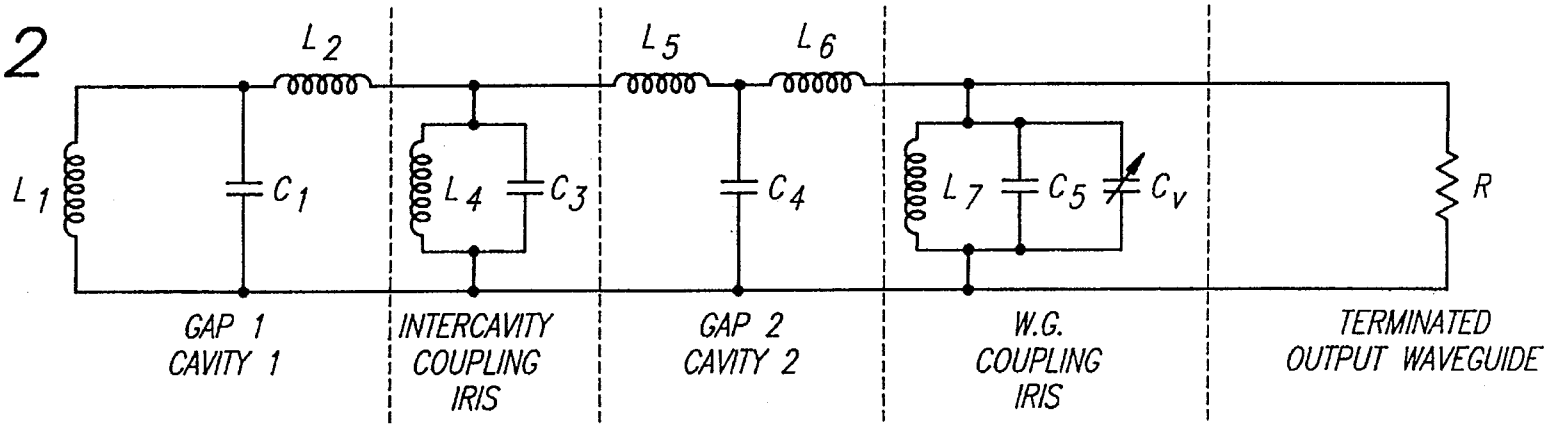
FIG. 2 illustrates an electrical schematic of a two-cavity EIOC utilizing the variable capacitive stub.

Similarly, FIG. 2 illustrates an electrical equivalent circuit for an EIK having two cavities. The EIK includes a first cavity, an intercavity coupling iris, a second cavity, a waveguide coupling iris, and an output waveguide. As in the klystron discussed above, the first cavity, with its corresponding electron beam gap (gap 1), is represented by a cavity capacitance $C_1$, and first and second portions of cavity inductance $L_1$, $L_2$, respectively. The intercavity coupling iris is represented by a coupling inductance $L_4$ and shunt capacitance $C_3$ disposed in parallel. The second cavity, with its corresponding electron beam and gap (gap 2), is represented by a cavity capacitance $C_4$, and a first portion of cavity inductance $L_5$ and a second portion of cavity inductance $L_6$. Gap 1 and Gap 2 are the interaction gaps of the electron beam with the fields of the respective cavities. The waveguide coupling iris is similar to that of the klystron discussed above, represented by an iris inductance $L_7$, a shunt capacitance $C_5$ and a variable capacitance $C_V$. As above, the resistance R represents the load of the output waveguide properly terminated in its characteristic impedance.

In general, the coupling between the output cavity and the output waveguide for both the klystron and EIK is a function of the resonant frequency of the waveguide coupling iris. Decreasing the resonant frequency of the iris increases the coupling, resulting in a lower external Q. Conversely, increasing the resonant frequency of the iris decreases the coupling, resulting in a higher external Q. The conventional method for lowering the external Q is to increase the iris inductance by enlarging the width of the coupling iris, since the iris resonant frequency is inversely proportional to the square root of LC.

In the present invention, the iris inductance $L_3$ of the klystron, and $L_7$ of the EIK, is intentionally selected higher than necessary, and the variable capacitance $C_V$ used to increase the shunt capacitance of the iris to further lower the iris resonant frequency. Thus, an initial target value of external Q is achieved with the ability to make later adjustments as desired.

Figures 3, 6:
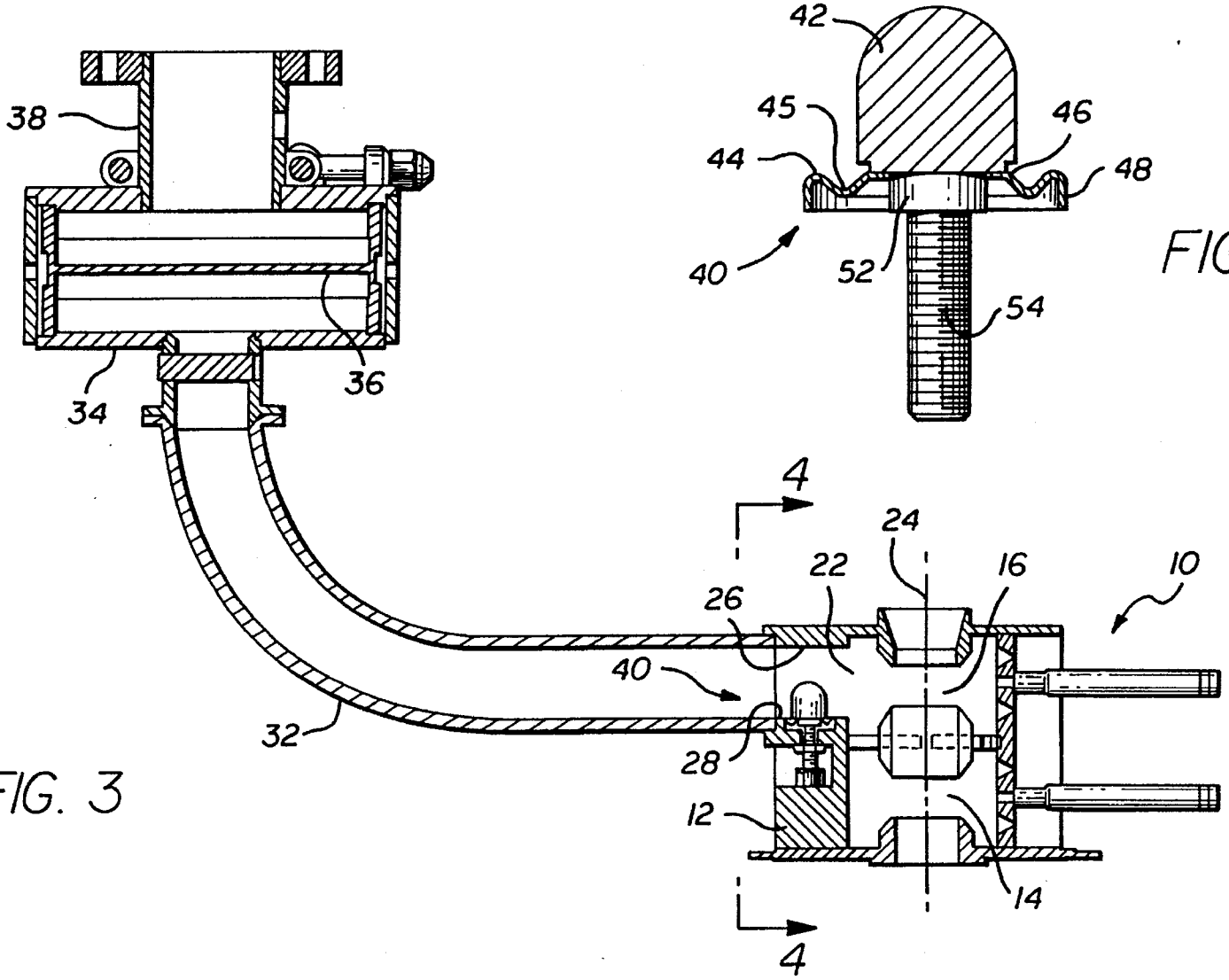
FIG. 3 is a sectional side view of the capacitive stub disposed in an output waveguide of an EIK.
FIG. 6 is an enlarged view of the capacitive stub.

FIG. 3 illustrates an EIK 10 having a capacitive stub constructed in accordance with the teachings of the present invention. The EIK 10 comprises a linear beam tube section 12 containing an EIOC. Output cavities 14 and 16 of the EIOC correspond to the first and second cavities discussed above with respect to FIG. 2. An electron gun (not shown) is disposed at an end of the tube section 12, and projects a beam of electrons 24 through the tube section. Energy in the beam 24 is given up to an RF signal traveling through the EIOC. The spent electrons of the beam 24 exit the tube section 12 and are collected within a collector (not shown).

The RF energy produced within the EIOC is removed from the tube section 12 through a coupling iris 22 to an output waveguide 32 that couples the RF energy to a window 34. The window 34 includes a vacuum barrier 36 that provides a seal between the vacuum environment existing within the EIOC, and the non-vacuum environment external to the EIOC. As known in the art, the barrier 36 is formed of an RF transparent material. Downstream from the window 34, a waveguide section 38 is provided to enable coupling of the RF energy from the EIK into an output device, such as an antenna, rotary joint, or other such output device.

A capacitive stub 40 is disposed adjacent the coupling iris 22 of the EIK 10. The stub 40 extends upwardly from a bottom broad wall 28 of the output waveguide 32 in the direction of a top broad wall 26 of the output waveguide. As will be set forth in greater detail below, the position of the stub 40 relative to the coupling iris 22 is adjustable from external to the waveguide 32 to vary the capacitance $C_V$ discussed above.

Figure 4:
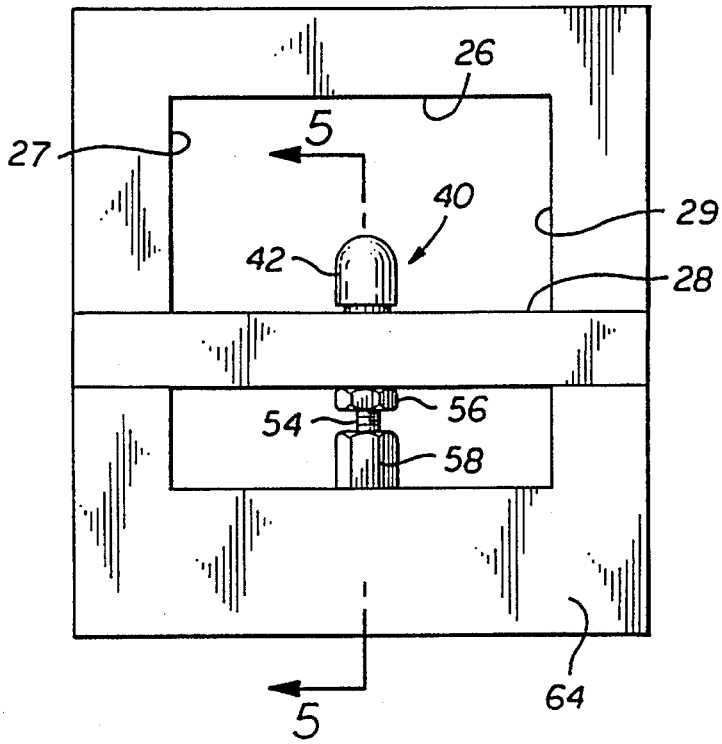
FIG. 4 is an end view of the capacitive stub disposed in an output waveguide taken through the section 4—4 of FIG. 3.
Figure 5:
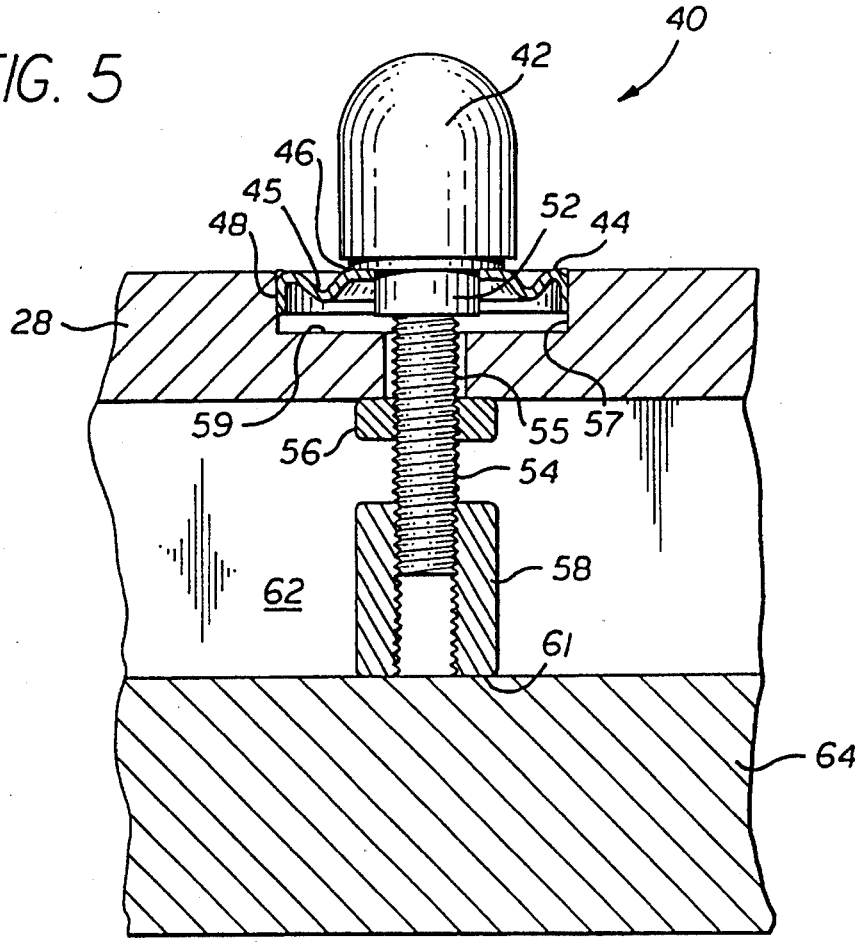
FIG. 5 is a sectional view of the capacitive stub taken through the section 5—5 of FIG. 4.

Referring now to FIGS. 4 through 6, construction of the capacitive stub 40 is provided in greater detail. The capacitive stub 40 comprises a stub portion 42, a diaphragm 44 (see FIGS. 5, 6), and a threaded portion 54. The stub portion 42 has a generally cylindrical shape with a rounded end. The stub portion 42 comprises an electrically conductive material, such as copper. The diaphragm 44 is generally disk shaped, with at least one pleat 45 (see FIGS. 5, 6) providing a range of motion for the stub portion 42, as will be described below. The diaphragm 44 (see FIGS. 5, 6) is coupled to a base 46 (see FIGS. 5, 6) of the stub portion 42 at a central portion of the diaphragm. The diaphragm 44 and stub base 46 are joined together by conventional welding technique, such as brazing. The threaded portion 54 extends axially from a sleeve 52 disposed beneath base 46 of the stub portion 42. The diaphragm 44 comprises an electrically conductive material, such as copper. Alternatively, the diaphragm 44 may comprise a high strength material, such as stainless steel, having a coating of an electrically conductive material, such as copper.

Referring now to FIGS. 4, 5, the waveguide bottom broad wall 28 has a large diameter bore 57 having a lower surface 59 (see FIG. 5), and a smaller diameter bore 55 (see FIGS. 5, 6) concentrically disposed at a center of the large diameter bore. The stub 40 is generally centered in the bottom broad wall 28 between the side walls 27, 29 (see FIG. 4). An outer portion 48 (see FIGS. 5, 6) of the diaphragm 44 is secured within the large diameter bore 57 by conventional welding technique, such as brazing. The threaded portion 54 extends downwardly through the small diameter bore 55. A first nut 56 threadingly engages the threaded portion 54, coming to rest against the bottom broad wall 28 at a lower surface thereof. A second nut 58 threadingly engages the threaded portion 54, having an end 61 (see FIG. 5) which is in contact with a lower structural portion 64. An open space 62 (see FIG. 5) provides access to the second nut 58 for adjustment of the nut as will be further described below.

In operation, the stub portion 42 is disposed generally adjacent a portion of the coupling iris 22, and acts as a variable capacitor to vary the capacitance of the iris. Changing the position of the stub portion 42 in the direction of the top broad wall 26 (see FIG. 4) of the waveguide 32 causes an increase in capacitance of the coupling iris 22, thereby lowering the external Q. By lowering the external Q, the bandwidth of the klystron is increased and the impedance of the output circuit decreased. Conversely, changing the position of the stub portion 42 in the direction of the bottom broad wall 28 of the waveguide 32 causes a decrease in capacitance of the coupling iris 22, thereby increasing the external Q. By increasing the external Q, the bandwidth of the klystron is decreased and the impedance of the output circuit increased. Thus, the klystron can be adjusted to achieve desired operational characteristics.

To move the stub portion 42, the operator first loosens the first nut 56. By rotation of the second nut 58, the threaded bore 54 moves the stub portion 42 either upward or downward. The bottom portion 61 of the second nut 58 remains in contact with the structural member 64. After the desired position for the stub portion 42 is achieved, the first nut 56 is tightened. Downward movement of the stub portion 42 is limited by contact between sleeve 52 and lower surface 59. Upward movement of the stub portion 42 is limited by the depth into the second nut 58 that the threaded portion 54 extends. After the stub portion 42 is raised beyond the point that the threaded portion 54 has disengaged with the second nut 58, further movement of the stub portion is precluded.

The overall diameter of the diaphragm 44 is selected so that it is small enough to decrease the distance between the stub portion 42 and iris 22, yet large enough to allow an acceptable vertical range of motion of the stub portion. Additional pleats 45 could be included in the diaphragm 44 to increase the effective range of motion of the stub portion 42, but that would increase the diameter of the diaphragm.

Having thus described a preferred embodiment of a capacitive stub for enhancing efficiency and bandwidth of a klystron, it should now be apparent to those skilled in the art that the aforestated objects and advantages for the within system have been achieved. It should also be appreciated by those skilled in the art that various modifications, adaptations, and alternative embodiments thereof may be made within the scope and spirit of the present invention. For example, the stub portion 42 of the present invention has been illustrated as extending from the bottom broad wall 28 of the waveguide. However, it should be apparent to those skilled in the art that the stub portion 42 could also be suspended from the top broad wall 26, and extend in the direction of the bottom broad wall 28. It should also be apparent that the capacitive stub could be utilized with conventional klystrons as well as EIKs.

The present invention is further defined by the following claims.

What is claimed is:

1. An apparatus for adjusting an impedance level of an iris coupling RF power from a klystron to an evacuated output waveguide, said apparatus comprising:

a capacitive stub extending from an inner surface of a broad wall of said output waveguide into a position adjacent at least a portion of said iris; and means coupled to said stub for adjusting said position of said stub from external to said output waveguide.

2. The apparatus of claim 1, wherein said stub comprises an electrically conductive material.

3. The apparatus of claim 1, wherein said stub has a rounded end.

4. The apparatus of claim 1, wherein said stub is comprised of copper.

5. The apparatus of claim 1, wherein said adjusting means further comprises:

a threaded member coupled between said stub and said broad wall of said output waveguide, and extending externally of said output waveguide; and a diaphragm coupling said stub and said output waveguide, said stub being centrally disposed in said diaphragm, said diaphragm maintaining a vacuum within said output waveguide and providing a range of motion of said stub;

whereby, rotation of said threaded member causes an associated change in said position of said stub.

6. The apparatus of claim 5 wherein said diaphragm comprises a copper plated surface.

7. An apparatus for adjusting an impedance level of an iris coupling RF power from an extended interaction klystron to an evacuated output waveguide, said apparatus comprising:

a capacitive stub extending from an inner surface of a broad wall of said output waveguide into a position adjacent at least a portion of said iris;

a threaded member coupled between said stub and said broad wall of said output waveguide, and extending externally of said output waveguide; and a diaphragm coupling said stub to said output waveguide, said diaphragm maintaining a vacuum within said output waveguide and providing a range of motion of said stub;

whereby, rotation of said threaded member causes an associated change in said position of said stub.

* * * * *